US007186207B2

(12) United States Patent
McKay, Jr. et al.

(10) Patent No.: US 7,186,207 B2
(45) Date of Patent: Mar. 6, 2007

(54) ROLLER CONSTRUCTION FOR DETRITUS REMOVAL

(75) Inventors: Nicholas D. McKay, Jr., Atlanta, GA (US); Peter John Williamson, Rexdale, CA (US)

(73) Assignee: The Evercare Company, Alpharetta, GA (US)

( * ) Notice: Subject to any disclaimer, the term of this patent is extended or adjusted under 35 U.S.C. 154(b) by 425 days.

(21) Appl. No.: 10/631,300

(22) Filed: Jul. 31, 2003

(65) Prior Publication Data

US 2005/0026759 A1 Feb. 3, 2005

(51) Int. Cl.
*B25F 5/02* (2006.01)
*B05C 1/08* (2006.01)

(52) U.S. Cl. ..... 492/56; 492/13; 492/19; 15/230.11

(58) Field of Classification Search ..... 492/13, 492/19, 38, 40, 41, 56; 15/104.002, 230.11; 428/43

See application file for complete search history.

(56) References Cited

U.S. PATENT DOCUMENTS

| | | | | |
|---|---|---|---|---|
| 2,269,712 | A * | 1/1942 | Gurley | 442/260 |
| 4,361,923 | A | 12/1982 | McKay | 15/104 |
| 4,399,579 | A | 8/1983 | McKay | 15/104 |
| 4,422,201 | A | 12/1983 | McKay | 15/104 |
| D273,058 | S | 3/1984 | McKay | D4/23.1 |
| D273,059 | S | 3/1984 | McKay | D4/23.1 |
| D276,763 | S | 12/1984 | McKay | D4/122 |
| 4,490,870 | A * | 1/1985 | Taub | 15/1.52 |
| 4,570,280 | A | 2/1986 | Roth | 15/104 |
| 4,905,337 | A | 3/1990 | McKay | 15/104 |
| 5,027,465 | A | 7/1991 | McKay | 15/104 |
| 5,878,457 | A * | 3/1999 | Cox et al. | 15/104.002 |
| 6,055,695 | A | 5/2000 | McKay, Jr. | 15/104.002 |
| 6,127,014 | A | 10/2000 | McKay, Jr. | 428/43 |
| 6,427,278 | B1 * | 8/2002 | McKay, Jr. | 15/104.002 |
| 6,548,136 | B1 * | 4/2003 | Piccini et al. | 428/43 |
| 2002/0144367 | A1 * | 10/2002 | McKay, Jr. | 15/104.002 |
| 2003/0039822 | A1 * | 2/2003 | Aalbers | 428/343 |
| 2003/0096074 | A1 * | 5/2003 | Kim | 428/40.1 |
| 2003/0229958 | A1 * | 12/2003 | Thompson et al. | 15/104.002 |

FOREIGN PATENT DOCUMENTS

GB 2204228 A * 11/1988

OTHER PUBLICATIONS

Azom.com description of Polyproplene—PP Structural Foam, www.azom.com/details.asp?ArticleID=822.*

* cited by examiner

*Primary Examiner*—Marc Jimenez
(74) *Attorney, Agent, or Firm*—Gifford, Krass, Groh, Sprinkle, Anderson & Citkowski, P.C.

(57) ABSTRACT

A detritus removal roller construction particularly suited for a lint roller is disclosed having an elongated strip with a backing layer and an adhesive layer overlying one side of the backing layer. The strip has a first end, a second end and two spaced apart sides and is wound from its first end to its second end into a tubular cylindrical roll. The backing layer is made of a compressible material which retains and/or creates an electrostatic charge in use.

11 Claims, 3 Drawing Sheets

ROLLER CONSTRUCTION FOR DETRITUS REMOVAL

BACKGROUND OF THE INVENTION

I. Field of the Invention

The present invention relates generally to rollers used for detritus removal.

II. Description of Related Art

Lint rollers have been long known and widely used for removing foreign particles, such as pet hair, lint and other detritus from flooring, clothing and the like. These previously known lint rollers typically comprise a handle having a tubular and cylindrical tape roll rotatably mounted to the handle.

Many of the previously known adhesive rollers for lint removal comprise a continuous strip having a paper backing layer with adhesive provided along one side of the backing. The strip is wound into a cylindrical roll, typically around a core, so that the adhesive faces outwardly. As the adhesive becomes depleted from use, a portion of the strip is torn from the roll to expose fresh adhesive on the next inner layer of the strip. This process continues until the entire roll has been depleted, at which time a new roll is mounted onto the handle.

One disadvantage of these previously known adhesive rollers is that the roller itself is relatively rigid in construction. As such, the roller is unable to conform to non-planar surfaces, such as a tile floor. Furthermore, unless the adhesive actually contacts the detritus desired to be removed from the surface, the detritus will remain on that surface.

A still further disadvantage of these previously known adhesive rollers is that the paper backing used for the strip does not retain an electrostatic charge. Such an electrostatic charge, however, is highly desirable for detritus removal.

A still further disadvantage of these previously known adhesive rollers is that the paper backing used with these adhesive rollers does not form an adequate carrier for certain coatings. Such coatings include, for example, antimicrobial coatings and fragrance coatings.

SUMMARY OF THE PRESENT INVENTION

The present invention provides a roller for detritus removal which overcomes all of the above-mentioned disadvantages of the previously known devices.

In brief, in a first embodiment of the invention the roller comprises an elongated strip having a backing layer, an adhesive layer overlying at least a portion of one side of the backing layer, and potentially a further backing or series of backings to add rigidity and prevent shredding. The strip has a first end, a second end and two spaced apart sides and is wound from its first end to its second end into a tubular cylindrical roll preferably around a core. In doing so, the roll includes multiple layers of overlying portions of the elongated strip with the adhesive facing outwardly.

Unlike the previously known adhesive rollers, however, the backing layer for the adhesive roller of the present invention is made of a material which retains or creates an electrostatic charge, such as foam and preferably a closed-cell foam or a non-woven static retaining material, such as polyethylene, proproplyene or polyolefan. A backing of a low-density or bi-density polyethylene film would help add strength to each layer and minimize shredding. The use of foam and/or non-woven material for the backing strip provides several advantages.

First, the backing layer is compressible and flexible unlike the previously known adhesive rollers so that the adhesive roller can conform to non-planar surfaces, such as a tile floor. In doing so, the compressibility and flexibility of the backing layer ensures that the adhesive roller maintains contact with the entire surface of non-planar surfaces thus effectively removing detritus from that surface.

A still further advantage of these backing layers is that the backing layer provides a better carrier for certain coatings and infusion layers. These coatings and infusion layers include, for example, antimicrobial coatings and fragrance coatings.

A still further advantage of these backing layers is that the backing layer retains and/or creates an electrostatic charge in use. As such, when the roller enjoys enhanced detritus removal with respect to the previously known rollers.

In a different embodiment, the backing layer is coated or impregnated with an antistatic agent that minimizes or eliminates static from the surface being cleaned.

Preferably, perforations or a cut are formed at predetermined intervals along the strip so that the interval between adjacent perforations corresponds substantially to one full revolution of the strip around the roll. Thus, when the adhesive on the outermost layer becomes depleted, a single layer is easily removed from the roll thus exposing fresh adhesive. Furthermore, the use of the foam or non-woven material as the backing layer also minimizes the likelihood of tearing of the strip during removal of the outermost layer except along the desired perforation line.

In a still further embodiment of the invention, the detritus removal roller comprises an elongated strip of non-woven electrostatic charge retaining material wound into a cylindrical roll but without an adhesive coating on the outwardly facing surface of the roll. In this embodiment the detritus removal is achieved by the electrostatic attraction between the roll and the detritus rather than by adhesive retention. Perforations, or a cut line, are preferably provided at spaced intervals along the strip corresponding substantially to one revolution of the roll to facilitate the removal of individual layers of the roll.

BRIEF DESCRIPTION OF THE DRAWING

A better understanding of the present invention will be had with reference to the accompanying drawing, wherein like reference characters refer to like parts throughout the several views, and in which.

DETAILED DESCRIPTION OF A PREFERRED EMBODIMENT OF THE PRESENT INVENTION

Figure 1:
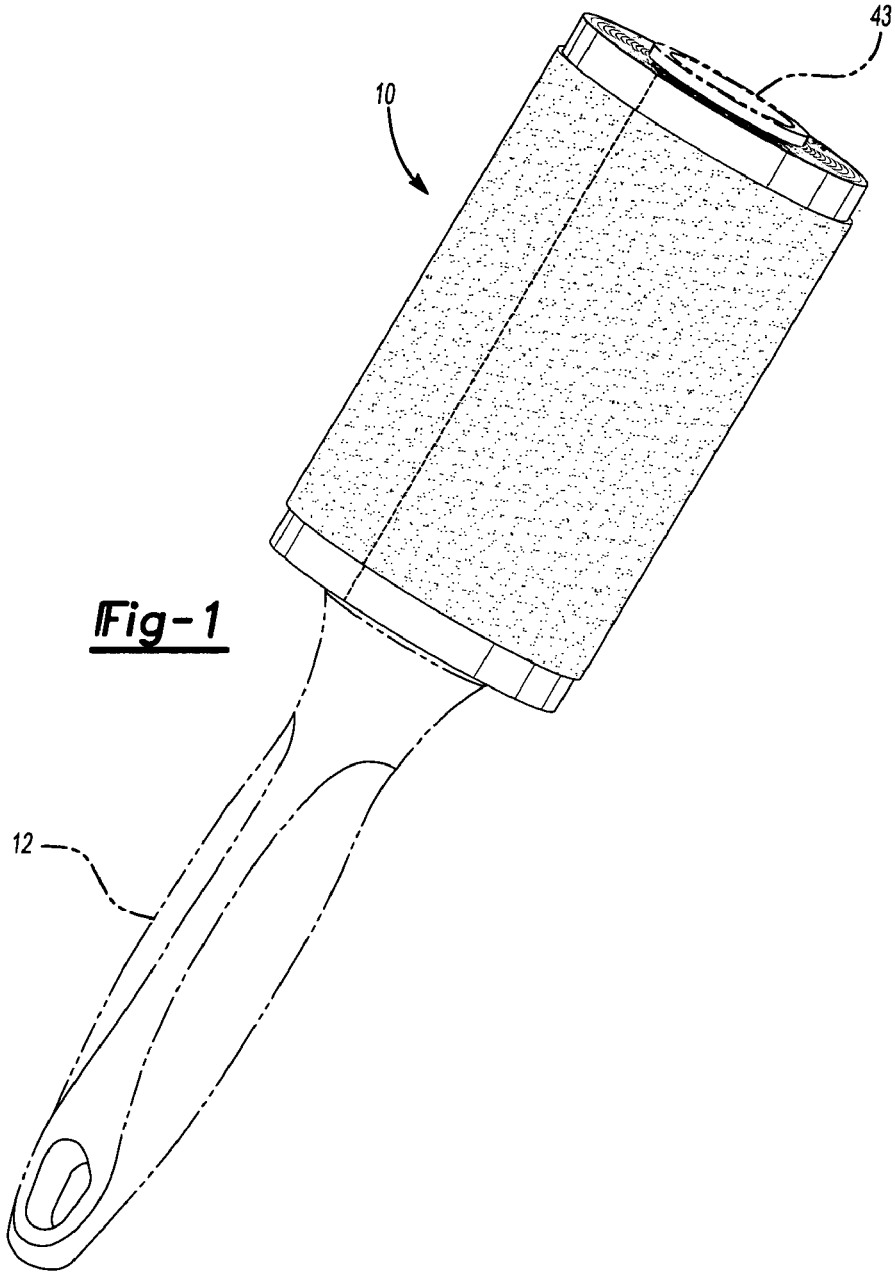
FIG. 1 is a perspective view illustrating a preferred embodiment of the present invention.

With reference first to FIG. 1, a preferred embodiment of the detritus removal roller construction 9 of the present invention is shown and comprises an adhesive roller construction 10 mounted to a handle 12 so that the roller construction 10 rotates relative to the handle 12. Furthermore, as illustrated in FIG. 1, the adhesive roller construction 10 is illustrated as a lint roller. No undue limitations, however, should be drawn therefrom since the adhesive roller construction 10 can also be used for many other applications, such as floor sweepers and the like.

Figure 2:
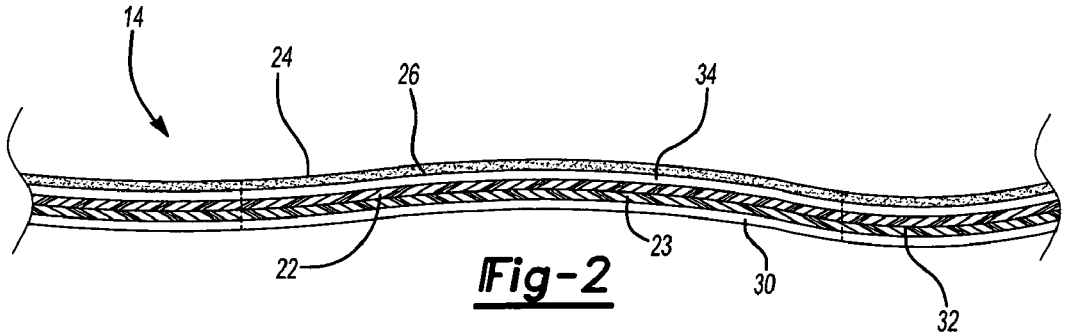
FIG. 2 is a fragmentary side view illustrating a portion of the strip and enlarged for clarity.
Figure 3:
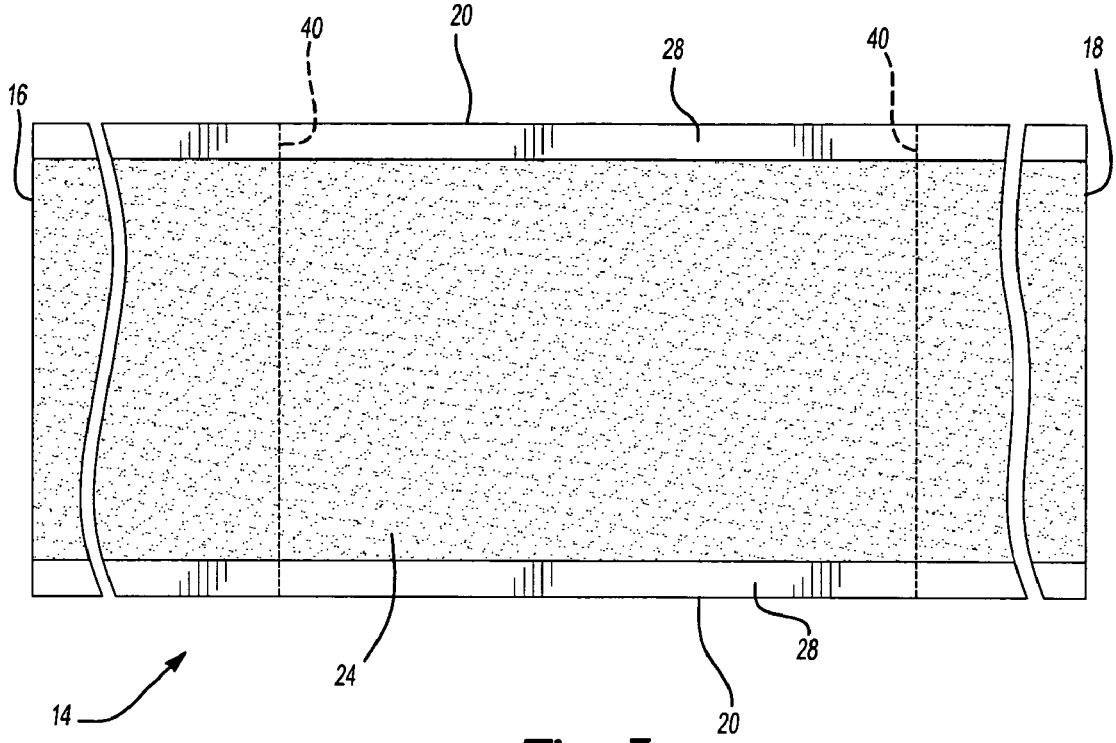
FIG. 3 is fragmentary plan view illustrating a portion of the elongated strip.

With reference now to FIGS. 2 and 3, the adhesive roller construction 10 comprises an elongated strip 14 having a first end 16, a second end 18 and two spaced apart sides 20. The elongated strip 14, furthermore, includes both a backing layer 22 and an adhesive layer 24 overlying at least a portion of one side 26 of the backing layer 22. However, as best shown in FIG. 3, the adhesive layer 24 is preferably spaced inwardly from each side 20 of the elongated strip 14 thus forming two dry edges 28. These dry edges 28 facilitate removal of individual layers from the adhesive roller construction 10 as will be shortly described.

Still referring to FIGS. 2 and 3, the backing layer 22 of the strip 14 comprises either a foam, and preferably a closed-cell foam, or a non-woven electrostatic charge retaining material, such as polyethylene. In both cases, the backing 22 is flexible, resilient and compressible.

With reference now particularly to FIG. 2, a release agent 30 preferably covers at least a portion of the side 32 of the backing layer 22 opposite from its adhesive coated side 26. This release agent 32 preferably comprises silicone and prevents or at least minimizes adhesion of overlying layers of the strip 14.

Optionally, a further coating or infusion layer (hereafter collectively referred to as "coating") 34 is applied to one or both sides of the backing layer 22. This coating 34 may comprise an antimicrobial coating, a fragrance coating, an anti-static coating or the like.

As best shown in FIG. 3, laterally extending perforations 40 are provided at spaced intervals along the strip 14 and the perforations may extend either perpendicularly with respect to the sides 20 (as shown) or may be angled with respect to the sides 20. The space between adjacent lines of perforation 40 correspond roughly to one circumference of the adhesive roller construction (FIG. 1).

Figure 4:
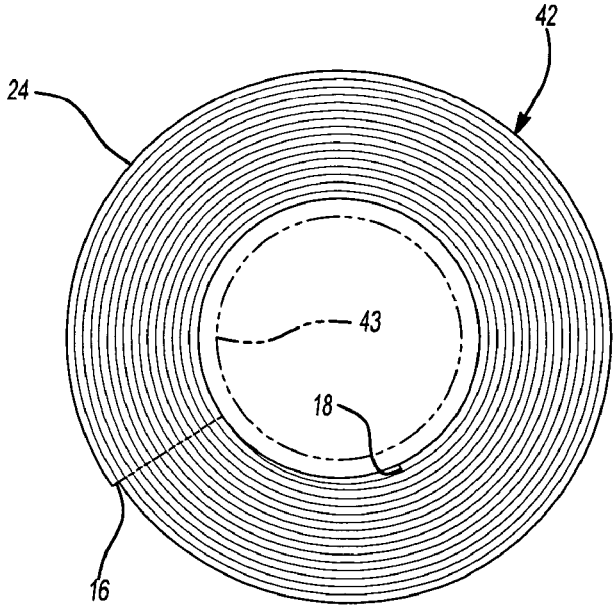
FIG. 4 is an end view of the preferred embodiment of the invention.

With reference now to FIG. 4, in order to form the adhesive roller 10, the elongated strip 14 is wound from its first end 16 to its second end 18 into a cylindrical roll 42 preferably around a core 43 so that the adhesive layer 24 faces outwardly from the roll 42. Furthermore, since the perforations 40 correspond substantially to one diameter of the roll 42, the perforations 40 define separate sheets which may be individually removed from the roll 42 by tearing the sheets from the roll 42.

In lieu of the perforations 40, a single cut may be formed through the roll after the strip 14 is wound into a cylindrical roll. Such a cut preferably terminates short of each side 20 in order to maintain the structural integrity of the roll.

In operation, the adhesive roller construction 10 is mounted to a handle 12 and moved along the surface to be cleaned. In doing so, the exposed adhesive 24 adhesively removes lint, pet hair and other detritus from the surface being cleaned. Furthermore, due to the flexibility, resiliency and compressibility of the backing layer 24, the roll 42 may be pressed downwardly along non-planar surfaces so that, in doing so, the adhesive roll 42 conforms to the non-planar surface thus ensuring that the entire surface is cleaned.

After extended use, the adhesive on the outermost layer or sheet of the adhesive roll 42 becomes spent and fails to adequately remove the detritus from the surface to be cleaned. When this occurs, the outermost layer or sheet of the roll 42 is simply removed from the roll 42 by tearing the sheet along the perforations 40 thereby exposing fresh adhesive on the outer surface of the roll 42.

When removing the outermost layer or sheet from the roll 42, the backing layer 22, due to its enhanced strength over the previously known paper backings, minimizes the likelihood of tearing of the backing layer 22 except along the line of perforations 40. Additionally, strength is improved with the potential of a second backing 23 (FIG. 2) of low-density or bi-density polyethylene or similar film laminated onto the foam or electrostatic surface to help prevent shedding.

The backing layer 22 is also further advantageous in that it represents a better carrier for certain coatings, such as antimicrobial coatings and fragrance coatings, than the previously known paper backings. Additionally, the backing layer 22 retains and/or creates an electrostatic charge during use, unlike the previously known paper backing layers, thus increasing the efficacy of the detritus removal.

Figure 5:
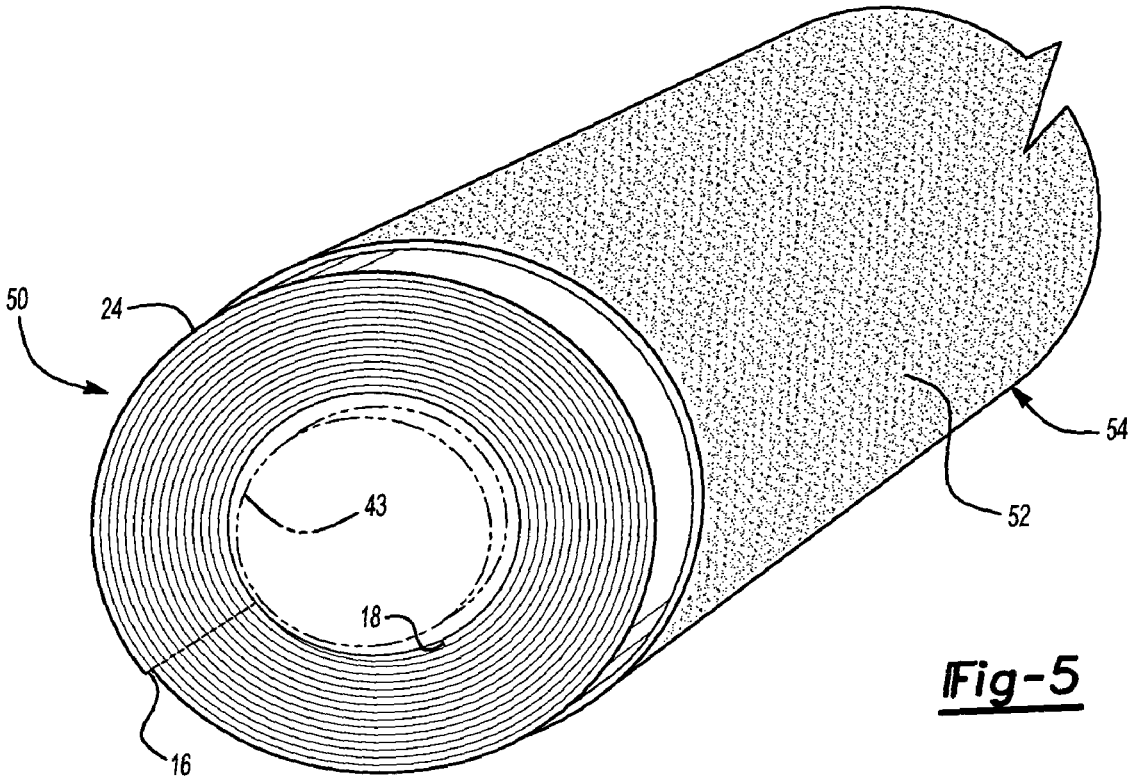
FIG. 5 is a perspective view illustrating a further embodiment of the invention.

With reference now to FIG. 5, a still further embodiment of the present invention is shown in which the detritus removal roller construction 50 comprises an elongated strip 52 of compressible, electrostatic charge retaining material, such as non-woven polyethylene wound into a cylindrical roll 54. Such an electrostatic charge is either applied to the strip 52 during the manufacturing process, or created by the roller construction 50 during use in the well known fashion. Alternatively, the strip may be constructed of a non-static compressible material, such as a hydrocarbon gas impregnated foam.

Unlike the previously described embodiment of the invention, the roller construction 50 does not have an adhesive layer on its outwardly facing side, but rather relies on electrostatic attraction to remove detritus. Perforations 56 are preferably provided at spaced intervals along the strip corresponding to one circumference of the roll 54 to facilitate the removal of individual layers of the roll 54.

Having described my invention, however, many modifications thereto will become apparent to those skilled in the art to which it pertains without deviation from the spirit of the invention as defined by the scope of the appended claims.

We claim:

1. An adhesive roller construction comprising:

an elongated strip, said strip having a backing layer and adhesive layer overlying one side of said backing layer, said strip having a first end, a second end and two spaced apart sides, said strip being wound from said first end to said second end into a tubular cylindrical roll, wherein said backing layer comprises a compressible foam layer.

2. The invention as defined in claim 1 wherein said foam layer comprises a closed-cell foam layer.

3. The invention as defined in claim 1 and comprising a release agent covering at least a portion of the other side of the backing layer.

4. The invention as defined in claim 3 wherein said release agent comprises silicone.

5. The invention as defined in claim 1 and comprising an antimicrobial coating on said one side of said backing layer.

6. The invention as defined in claim 1 and comprising a fragrance coating applied to said backing layer.

7. The invention as defined in claim 1 and comprising an antistatic coating applied to said backing layer.

8. The invention as defined in claim 1 and comprising a plurality of perforation lines extending between said sides of said strip at predetermined intervals therealong, said predetermined interval corresponding substantially to one revolution of said strip around the roll.

9. The invention as defined in claim 1 wherein said backing layer comprises a non-woven electrostatic charge retaining material.

10. The invention as defined in claim 9 wherein said backing layer comprises polyethylene.

11. The invention as defined in claim 1 wherein said backing layer comprises a hydrocarbon gas impregnated foam.

* * * * *